US006527267B1

(12) United States Patent
Kuwata et al.

(10) Patent No.: US 6,527,267 B1
(45) Date of Patent: Mar. 4, 2003

(54) SHEET CONVEYING APPARATUS, SHEET FEEDING APPARATUS, AND IMAGE FORMING APPARATUS

(75) Inventors: Takashi Kuwata, Numazu (JP); Yasuhiro Uchida, Shizuoka-ken (JP); Makoto Izumi, Shizuoka-ken (JP); Minoru Kawanishi, Shizuoka-ken (JP); Kenichiro Isobe, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 121 days.

(21) Appl. No.: 09/691,063

(22) Filed: Oct. 19, 2000

(30) Foreign Application Priority Data

Oct. 20, 1999 (JP) ..... 11-298168

(51) Int. Cl.[7] ..... B65H 5/26
(52) U.S. Cl. ..... 271/9.13
(58) Field of Search ..... 271/9.13, 225, 271/184

(56) References Cited

U.S. PATENT DOCUMENTS 5,052,670 A * 10/1991 Makiura et al. ..... 271/9.13
5,599,117 A * 2/1997 Faes et al. ..... 271/9.13
5,772,197 A * 6/1998 Aoki et al. ..... 270/58.08

* cited by examiner

*Primary Examiner*—Christopher P. Ellis
*Assistant Examiner*—Mark A. Deuble
(74) *Attorney, Agent, or Firm*—Fitzpatrick, Cella, Harper & Scinto

(57) ABSTRACT

The present invention related to a sheet conveying apparatus comprising a first unit, a second unit and a guide member. The first unit includes a first sheet conveyance route, a second sheet conveyance route, a first delivery opening for delivering, from the first unit, a sheet or sheets from the first sheet conveyance route, and a second delivery opening for delivering, from the second unit, a sheet or sheets from the second sheet conveyance route. The second unit is positioned with a space to the first unit, the second unit having a third sheet conveyance route, and a single introduction opening for introducing, to the third sheet conveyance route, a sheet or sheets delivered from the first delivery opening and the second delivery opening. At least a part of the guide member is disposed at a space between the first unit and the second unit, having a first guide surface for guiding the sheet or sheets from the first delivery opening to the introduction opening, and a second guide surface for guiding the sheet or sheets from the second delivery opening to the introduction opening.

12 Claims, 8 Drawing Sheets

SHEET CONVEYING APPARATUS, SHEET FEEDING APPARATUS, AND IMAGE FORMING APPARATUS

BACKGROUND OF THE INVENTION

1. Field of the Invention

This invention relates to a sheet conveying apparatus, a sheet feeding apparatus, and a sheet delivering apparatus for feeding or delivering original documents and recording sheets to an image forming apparatus such as a printer, facsimile machine, or photocopier.

2. Description of Prior Art

Image forming apparatuses such as printers, facsimile machines, and photocopiers are recently produced with high performance in accordance with increased processing speed, and have a trend to increase the capacity of the sheet stacking apparatus and the sheet delivering apparatus.

Such an image forming apparatus capable of processing sheets in a large volume can be used in coupling with, in meeting usage of the users, large capacity sheet feeding apparatus or sheet stacking apparatus (sheet processing apparatus) as their optional choices.

A type of the large capacity sheet conveying apparatuses has sheet containing means and feeding means provided on left and right sides. In this sheet feeding apparatus, the conveyance route from one sheet containing means is disposed over the other sheet containing means and the feeding means.

FIG. 8 shows such a conventional apparatus. The conventional image forming apparatus X is constituted of a lower sheet feeding apparatus 300 and an upper laser beam printer 400. In this sheet feeding apparatus 300, a sheet S fed from a left side sheet containing means 303 by a feeding means 305 passes through a conveyance route 306 placed above a right side sheet containing means 304 and is sent to the image forming apparatus after merging with a conveyance route 307 from the right side sheet containing means 304. Position sensor units 301, 302 are formed on the right and left sides slightly before the merging point to detect the sheet position. The sensor unit is constituted of a flag, a rotary shaft of a flag, and a photo sensor. In the laser beam printer 400, a sheet conveyance route 402 extends from a tray stacking sheets S and reaches a delivery tray 405 by way of a process cartridge 407 and a fixing means 404, as the image forming means. An option conveyance route 406 in connection with the conveyance route 310 integrating the two conveyance routes 302, 307 at the sheet feeding apparatus 300 as described above merges to the sheet conveyance route 402.

In the sheet feeding apparatus, however, a merging space is required in a vertical direction because the conveyance route from the left side sheet containing means and the right side sheet containing means are merged in the sheet feeding apparatus, so that the stacking height of the right and left side sheet containing means is limited, and so that the sheet feeding apparatus cannot store many sheets.

The position sensor units 301, 302 for the left side sheet containing means and the right side sheet containing means are placed independently at positions separating from one another, and therefore, wiring for the photo sensor becomes complicated, and the apparatus becomes expensive since a pair of the flag rotary shafts and sensor holders has to be provided.

SUMMARY OF THE INVENTION

An invented structure to accomplish the above objects has a sheet conveying apparatus characterized in including a first unit and a second unit formed with a space between the first and second units, the first unit including a first sheet conveyance route, a second sheet conveyance route, a first delivery opening for delivering, from the first unit, a sheet or sheets from the first sheet conveyance route, and a second delivery opening for delivering, from the second unit, a sheet or sheets from the second sheet conveyance route, the second unit having a third sheet conveyance route, and a single introduction opening for introducing, to the third sheet conveyance route, a sheet or sheets delivered from the first delivery opening and the second delivery opening, and a guide member, disposed at a space between the first unit and the second unit, having a first guide surface for guiding the sheet or sheets from the first delivery opening to the introduction opening, and a second guide surface for guiding the sheet or sheets from the second delivery opening to the introduction opening.

According to the invention, because the guide member, at least partly, is disposed between the first unit and the second unit, the merging point of the plural conveyance routes can be placed in the space between the units, and therefore, the first unit can be made compact. Particularly, where the first unit is a sheet feeding apparatus for feeding the sheet to the second unit having the image forming means, the conveyance route can be placed at a further upper position, and the sheet stacking amount can be made relatively larger.

In another aspect, an invented sheet feeding apparatus includes a detecting means for detecting whether any sheet exists in two sheet conveyance routes located adjacently. The detecting means includes in a region between the two conveyance routes two sensors, a rotary shaft, and two sensor flags rotatably with respect to the rotary shaft, placed at a position for shielding each conveyance route. Each of the sensor flags has a region that a contacting portion of the flag in contact with the sheet coincides with each other in a sheet width direction as the perpendicular direction to the sheet conveyance direction. With the guide member having the sensor thus structured, the plural conveyance routes can be detected with such a simple structure.

DETAILED DESCRIPTION OF PREFERRED EMBODIMENTS

Figure 1:
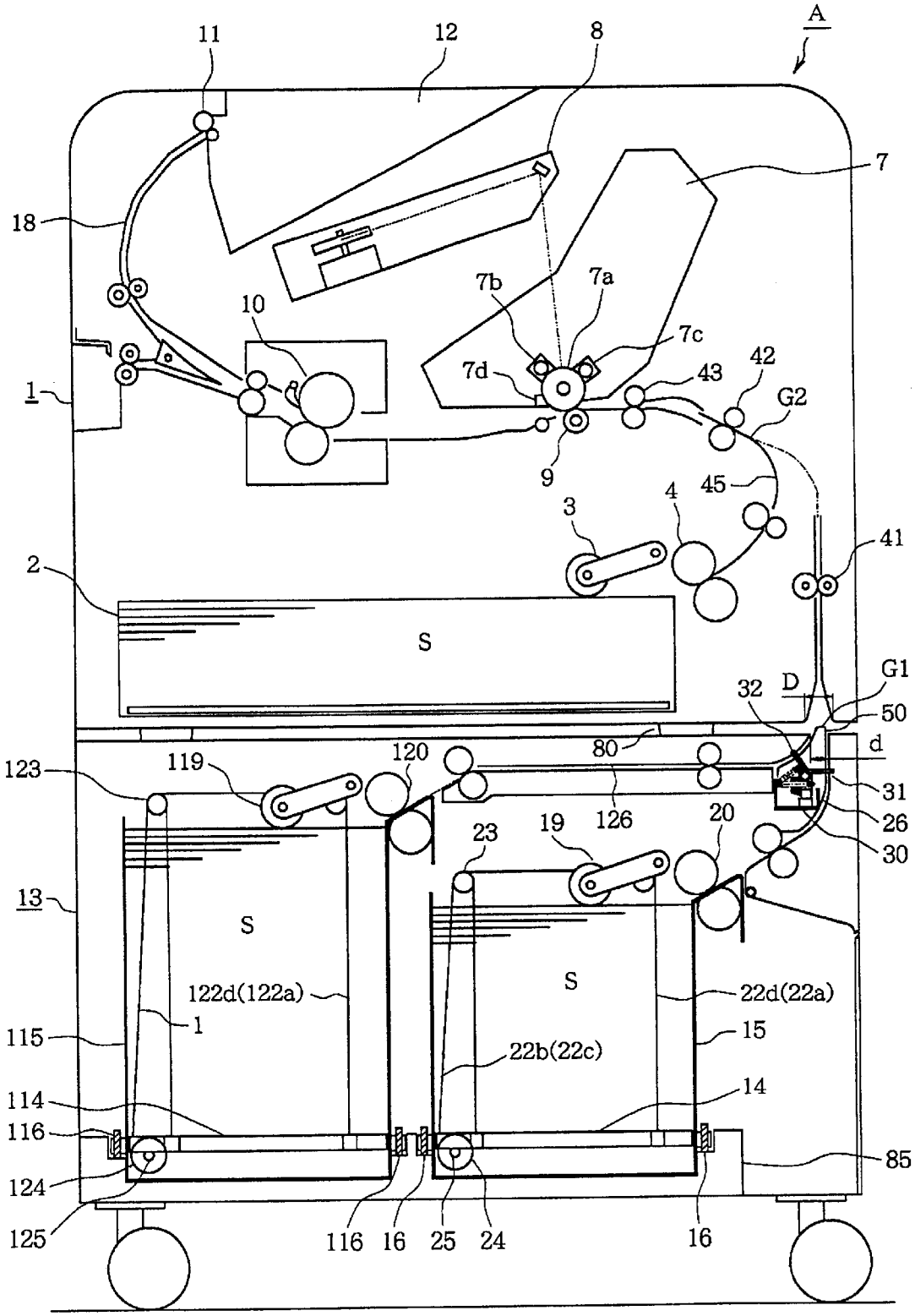
FIG. 1 is a cross section showing the whole structure of a printer to which a deck is mounted.

Referring to FIG. 1 to FIG. 4, a sheet feeding apparatus as a first embodiment of the invention is described. It is to be noted that in this embodiment, a sheet feeding apparatus 14 coupled to a laser beam printer 1 (hereinafter, referred to as "LBP 1"), as an example, is described for the invention.

Numeral A is an image forming apparatus and is constituted of a sheet feeding portion (image forming apparatus 13) as a first unit and an image forming portion (LBP 1) as a second unit.

First of all, in the LBP 1, numeral 2 is a cassette containing sheets S in a stacking manner and is attached to a lower portion of the LBP 1 detachably in a near side direction. Numeral 3 is a pickup roller and sends the sheets S stacked on the cassette 2 from the topmost side. Numeral 4 is a retard roller pair for separately conveying the sent sheets sheet by sheet.

Numeral 7 is a process cartridge incorporating known processing mean for forming images on the conveyed sheet and is detachably attached to the apparatus body.

In the process cartridge 7, incorporated are a photosensitive drum 7*a* as an image carrier, a charger 7*b* for charging the surface of the drum 7*a*, a developing apparatus for developing latent images formed on the drum 7*a* to produce developed images (toner images), a cleaner 7*d* for removing waste toner remaining on the surface of the drum 7*a*, and the like.

Latent images are recorded on the photosensitive drum 7*a* by radiating laser beam from a laser exposing apparatus 8 according to image information. A transfer roller 9 is pushed to the photosensitive drum 7*a*, and when the sheet S passes between the photosensitive drum 7*a* and the transfer roller 9, the toner image on the photosensitive drum 7*a* is transferred to the sheet S in application of a voltage having a reverse polarity to the toner image.

Numeral 10 is a fixing apparatus for fixing the transferred image by application of heats and pressure to the sheet S after image transfer.

The image forming means is made of the process cartridge 7, the transfer roller 9, the fixing apparatus 10, and the like.

The sheet S after image transfer is conveyed through a reverse path 18 and delivered by a delivery roller pair 11 on a delivery tray 12 formed on the top of the apparatus in a face down manner in which the image side faces down.

Next, the sheet feeding apparatus as the first unit is described. A deck as a sheet feeding apparatus is also used as the mounting base of the LBP 1 and placed below the LBP 1. The sheet feeding apparatus 13 contains in a stacking manner the sheets S having a relatively large size which cannot be contained in the cassette 2. The sheet feeding apparatus 13 can supply the sheets S in a large volume to the LBP 1.

Storages 15, 115 are structured to be pulled in a near side direction by rollers 16, 116 formed on left and right sides and a guide 85 formed at a frame 17. Numerals 14, 114 are trays movable up and down in stacking the sheets S (respectively, first sheet feeding means, and second sheet feeding means) disposed in the left and right storages 15, 115 and are installed to be pulled with the storages to stack the sheets S on the trays 14, 114.

At the frame of the sheet feeding apparatus 13, provided are pickup rollers 19, 119 for feeding out the sheets S on the trays 14, 114 from the topmost sheet of the sheets S, and retard roller pair 20, 120 for separately conveying sheets S sheet by sheet.

The trays 14, 114 are suspended inside the storages 15, 115 where wire ropes 22*a*, 22*b*, 22*c*, 22*d* and 122*a*, 122*b*, 122*c*, 122*d* are secured around four corners. The other ends of wire ropes are coupled to respective winches 24, 124 arranged on front and rear sides of the lower portion of the storages 15, 15 by way of pulleys 23*a*, 23*b*, 23*c*, 23*d* and 123*a*, 123*b*, 123*c*, 123*d* formed rotatably at a top of the storages 15, 115.

The winches 24, 124 are secured to winding shafts 25, 125, respectively, to which gears not shown are attached and are coupled to a gear of a motor M formed at the frame where the storages 15, 115 are attached to the frame. The winches 24, 124 are rotated by drive of the motor M, thereby lifting up the trays 14, 114 upon winding the respective wire ropes on the bodies of the winches 24, 124.

Where the storages 15, 115 are pulled out of the frame, the gears of the winches 24, 124 are disengaged from the gear of the motor M1 secured to the frame 17, and the respective wound wire ropes are wound back by self-weights of the sheets S and the trays 14, 114 to move down the trays 14, 114.

Brake dumpers, not shown, are formed at the winding shafts 25, 125 to soften impacts given when the trays 14, 114 move down and are coupled to gears attached to the winding shafts 25, 125.

Paper surface sensors, not shown, are formed at the frame for detecting the paper surface (top surface) of the trays 14, 114 moving up, and when the sensors detect the paper surface (top surface) of the trays 14, 114 moving up, the motor M rotating the winches 24, 124 stops driving.

The sheets S stacked on the trays 14, 114 are fed out by the pickup rollers 19, 119 and the retard rollers 20, 120 formed at the frame 17, and where the paper surface is lowered, the motor M is driven to move the trays 14, 114 up until the detecting means detects the paper surface. The topmost surface of the sheets S stacked on the trays 14, 114, thus, can be always maintained at substantially a constant level.

Now, a sheet conveyance route and operation in which the sheets S from the tray 14 on the right side are sent to the LBP 1 as an image forming apparatus. A first sheet conveyance route 126 extending from the left side tray 14 and a second sheet conveyance route 26 extending from the right side tray 114 have a first delivery opening 126*a* and a second delivery opening 26*a*, which are independent of each other and are formed on a top of the sheet feeding apparatus 13, and a merging guide 50 is arranged between the routes.

The sheets S are fed out by the pickup roller 19, and the sheets S separated by the retard roller pair 20 are delivered out of the sheet feeding apparatus 13 through the second conveyance route 26 after moving rotationally a flag 31 of a position sensor unit 30. A second guide surface 50*c* is formed by the merging guide at a part of the sheet conveyance route 26. The sheets S pass by the merging guide 50 being formed of ribs provided in a plural number extending in the sheet width direction and having a tip 50*a* located at a higher position than the mounting surface 80 for the sheet feeding apparatus 13 and rubber pads 80 of the LBP 1. That is, a merging point G1 of the conveyance route 26 from the right side feeding means and the conveyance route 126, as described above, from the left side feeding means is formed above the merging guide 50, and a sheet from either route is conveyed to the LBP 1. At that time, because the opening width d of a second delivery opening 26*a* and a second delivery opening 126*a* formed at a top of the sheet feeding apparatus 13 is narrower than a width D of an introduction opening of the LBP 1, the sheet S can enter smoothly into the LBP 1.

Next, operation for feeding sheets from the left side tray 114 to the image forming apparatus is described.

The sheet S fed out of the pickup roller 119 and separated by the retard roller pair 120 is delivered from the sheet feeding apparatus 13 after rotating the flag 31 of the position sensor unit 30 upon passing a conveyance portion 51 formed at a top of the storage 15. The sheet S is conveyed to the LBP 1 upon passing the merging point G1 for the first sheet conveyance route 126 from the left side feeding means defined by the merging guide 50 having the tip at a higher position than the mounting surface for the sheet feeding apparatus 13 and the rubber pads 80 of the LBP 1.

The sheet S is at that time conveyed as sliding on a first guide surface 50*b* along the first guide surface 50*b*, having a radius of curvature, of the merging guide 50. As for the sheet conveyance from this side, the sheet S can be entered smoothly into the LBP 1 because the width d of the outlet of the sheet feeding apparatus 13 is set narrower than the width D of the introduction opening of the LBP 1.

The sheet S fed from the respective feeding means is successively sent to a conveyance roller pair 41, and then passes a merging point G2 also for a conveyance route 45 provided for sheets fed by the pickup roller 3 from the cassette 2 of the LBP 1 to be sent to the image forming portion by a roller pair 42, 43.

Since a part of the merging guide 50 and the merging point G1 are provided between the sheet feeding apparatus 13 and the LBP 1, no merging point is required to be formed inside the sheet feeding apparatus 13. Therefore, the conveyance portion 51 located over the storage 15 can be placed upwardly, so that the sheet stacking amount can be relatively increased in the storages 15, 115 serving as a sheet stacking means.

Figure 2:
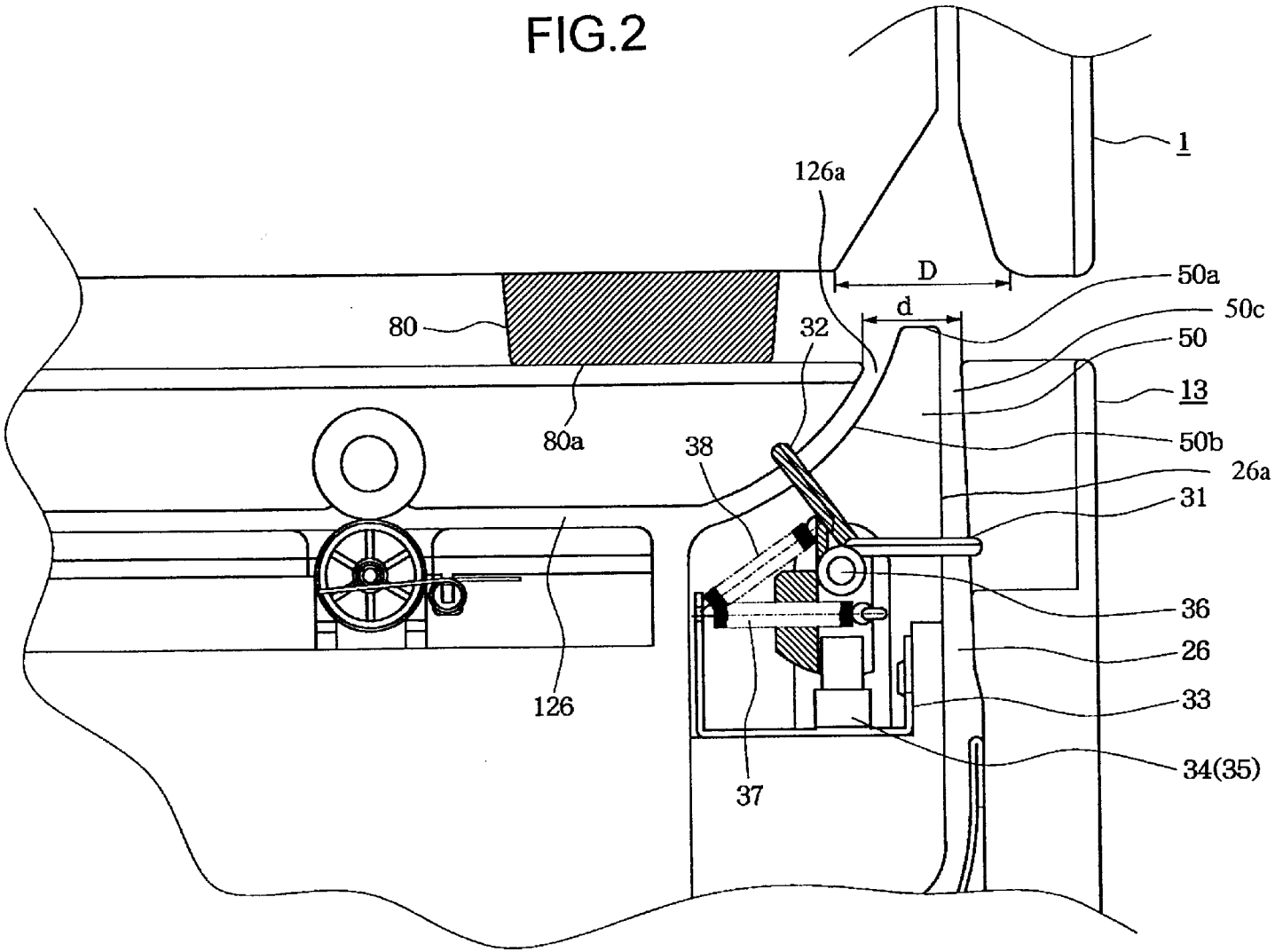
FIG. 2 is a cross section showing a conveyance portion according to a first embodiment of the invention.
Figure 3:
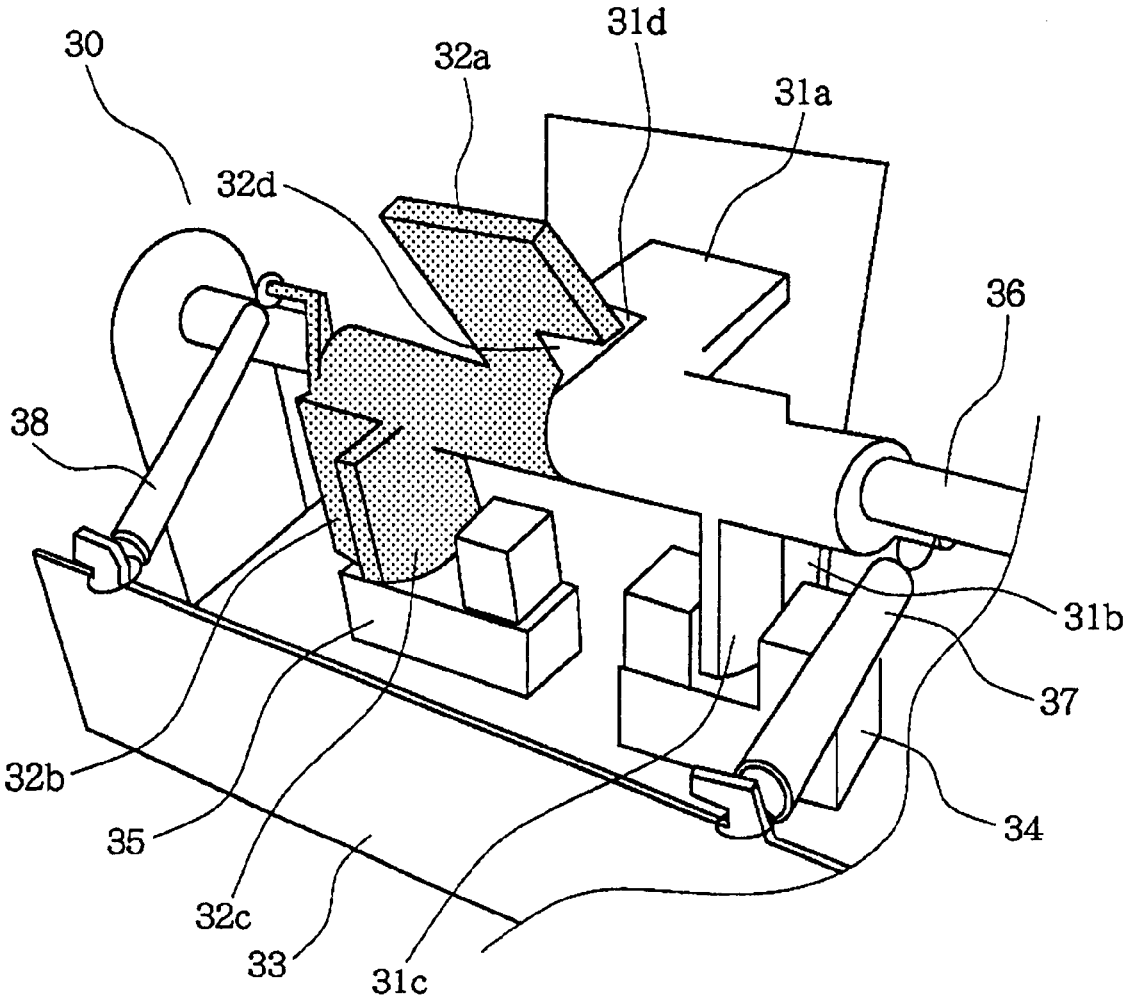
FIG. 3 is a perspective view showing a sensor unit according to the first embodiment of the invention.
Figure 4:
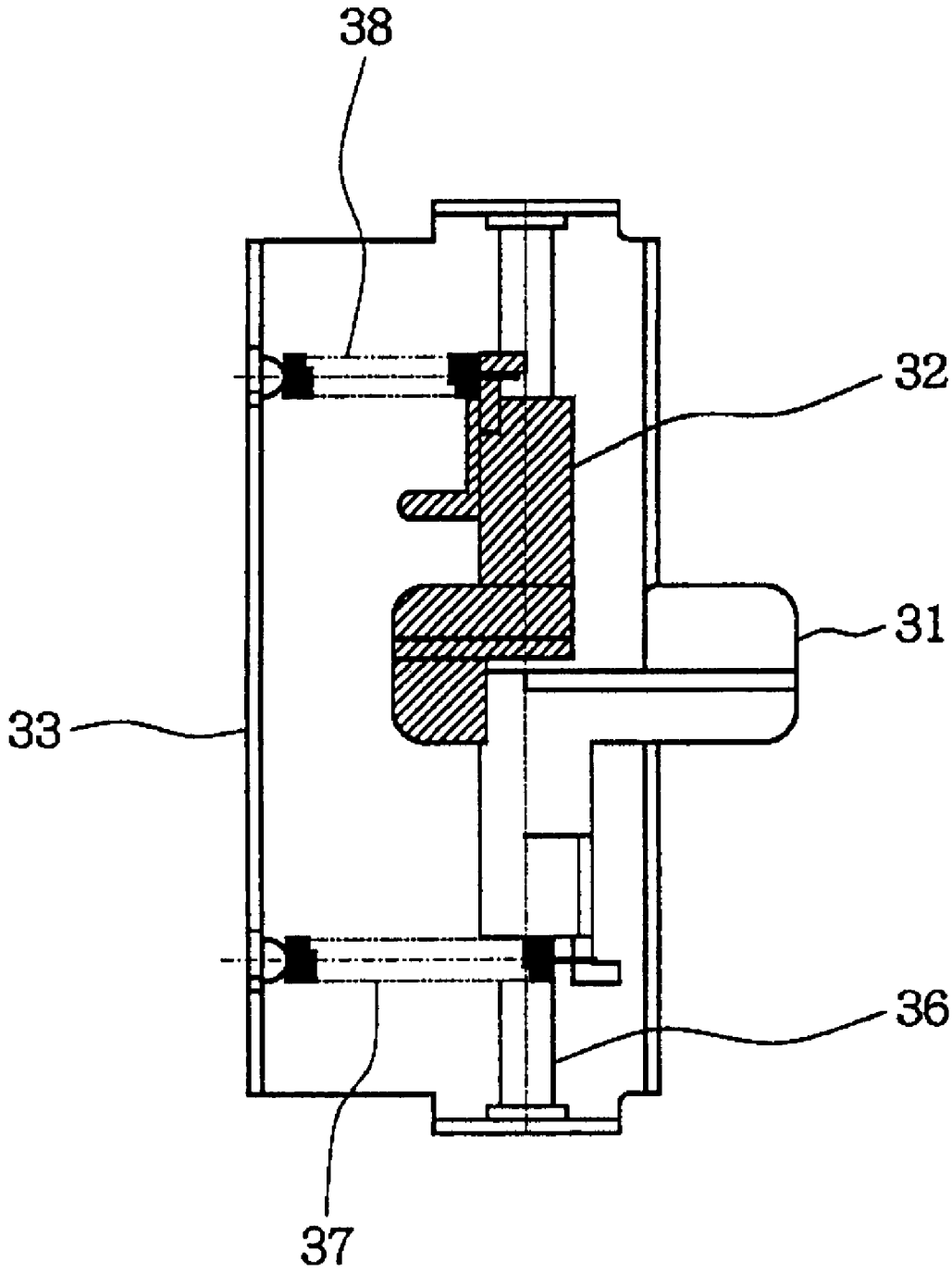
FIG. 4 is a top view showing a sensor unit according to the first embodiment of the invention.

Now, a structure of the conveyance portion around the merging point G1 is described. FIG. 2 is a cross section around the merging point G1; FIG. 3 is a perspective view of the position sensor unit 30; FIG. 4 is a top view of the position sensor unit 30.

The position sensor unit 30 is located at a region between the sheet conveyance route 126 from the left side feeding means 19 and the sheet conveyance route 26 from the right side feeding means 19. In the structure of the unit 30, two photo sensors 34, 35 and a rotary shaft 36 are secured to a stay 33, and the flag 32 and the flag 31 are independently rotatable around the rotary shaft 36 where the flag 32 is urged in the counterclockwise direction by a pulling spring 38 and where the flag 31 is urged in the clockwise direction by a pulling spring 37.

Shapes of the flags 31, 32 are described. Actuators 31*a*, 32*a* serving as contact portions that the flags 31, 32 are in contact with the sheet, both have a predetermined width located at a position including a center position in the width direction of the sheet to be fed.

Even where the actuators 31*a*, 32*a* are disposed to occupy the common position in the width direction of the respective sheet conveyance routes, the actuators 31*a*, 32*a* are formed with cutouts 31*d*, 32*d*, respectively, as to avoid interference with each other where the flags 31, 32 are independently operable where the sheets S are conveyed to the respective conveyance routes.

The flag 31 and the flag 32 have walls 31*b*, 32*b*, respectively, and the flags urged by the pulling springs 37, 38 are stopped at positions at which the walls 31*b*, 32*b* of the respective flags are in contact with the photo sensors 34, 35 to set the positions.

Photo-shielding portions of the photo sensors 34, 35 have photo shielding plates 31*c*, 32*c* of the flags, respectively. Where no sheet exists, the photo shielding plates 31*c*, 32*c* of the flags cut off light from the light emitting devices of the photo sensors so that the light does not reach the light receiving device, and the photo sensors enter into the off state. When the sheet S exists, the flags 31, 32 moves rotatively to render the photo shielding plates 31*c*, 32*c* of the flags move back from the light emitting devices to pass the light.

Next, operation of the flags is described. Where no sheet exists in the conveyance routes or it is at the initial stage, the flags 31, 32 are urged by the pulling springs 37,38 to positions to shield the light at the photo sensors 34, 35, respectively. Where the flag 32 is rotated in the clockwise direction and the flag 31 is rotated in the counterclockwise direction where the front end of the sheet S is conveyed through the conveyance routes, the photo shielding plates 31*c*, 32*c* shielding the photo sensors 34, 35 also rotate to render the photo sensors 34, 35 at a light passing state. When the rear end of the sheet S passes, the flags 31, 32 are returned to the initial state by the pulling springs 37, 38.

With this structure, the position sensor unit, which was independently formed for each conveyance route in conventional apparatuses, can be made in a united body, so that the apparatus can be made compact and less complicated. Moreover, inexpensive sheet feeding apparatuses can be provided because the position sensor can be made less complicated.

Figure 5:
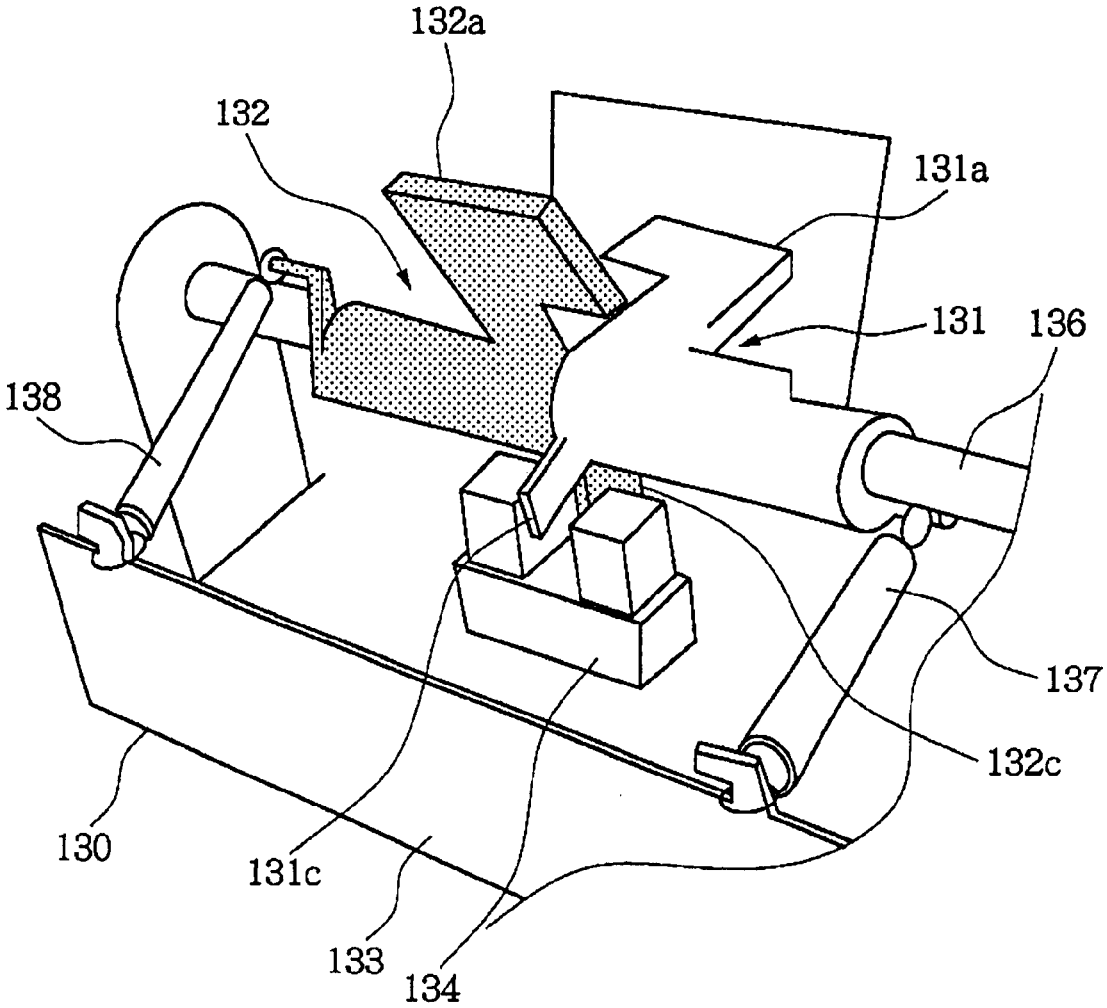
FIG. 5 is a perspective view showing a sensor unit according to a second embodiment of the invention.

Referring to FIG. 5, a second embodiment is described.

Although the two photo sensors are provided in the position sensor unit 30 in the first embodiment, the second embodiment has a feature that a single photo sensor is formed.

FIG. 5 is a perspective view of a position sensor unit 130. A stay 133 is secured to a rotary shaft 136 in the same way as those in the first embodiment, and the flag 131 and the flag 132 are rotatable around the rotary shaft 136 where the flag 132 is urged in the counterclockwise direction by a pulling spring 138 and where the flag 131 is urged in the clockwise direction by a pulling spring 137.

Differences in the structure from the first embodiment are only that a sole photo sensor 134 is provided at a center of the stay 133 and that the photo-shielding plates of the flags 131, 132 have different shapes. A wall serving as a stopper for rotation of the flags is not shown.

Next, operation of flags is described. Where no sheet exists in the conveyance routes or it is at the initial stage, the flags 131, 132 are urged by the pulling springs 137, 138 to positions to pass the light at the photo sensor 134, though in the first embodiment at the shielding state.

Where the flag 132 is rotated in the clockwise direction where the front end of the sheet S is conveyed through the conveyance route 126 to contact with the actuator 132*a* in the case that the sheet S is fed from the left side feeding means 119, the photo shielding plates 132*c* at a position escaping from the photo sensor 134 also rotates to render the photo sensor 134 at a light shielding state. When the rear end of the sheet S passes, the flag 132 is returned to the initial state by the pulling spring 138.

Where the flag 131 is rotated in the counterclockwise direction where the front end of the sheet S is conveyed through the conveyance route 26 to contact with the actuator 131*a* in the case that the sheet S is fed from the right side feeding means 19, the photo shielding plates 131*c* at a position escaping from the photo sensor 134 also rotates to render the photo sensor 134 at a light shielding state. When the rear end of the sheet S passes, the flag 131 is returned to the initial state by the pulling spring 137.

With this position sensor 130, judgment as to whether the sheet is conveyed from either the right side feeding means or the left side feeding means cannot be made since only one photo sensor is provided in this embodiment, but the controller for the image forming apparatus (A) body for controlling the sheet feeding apparatus 13 knows which feeding means makes feeding, so that this information can be utilized.

Figure 6B:
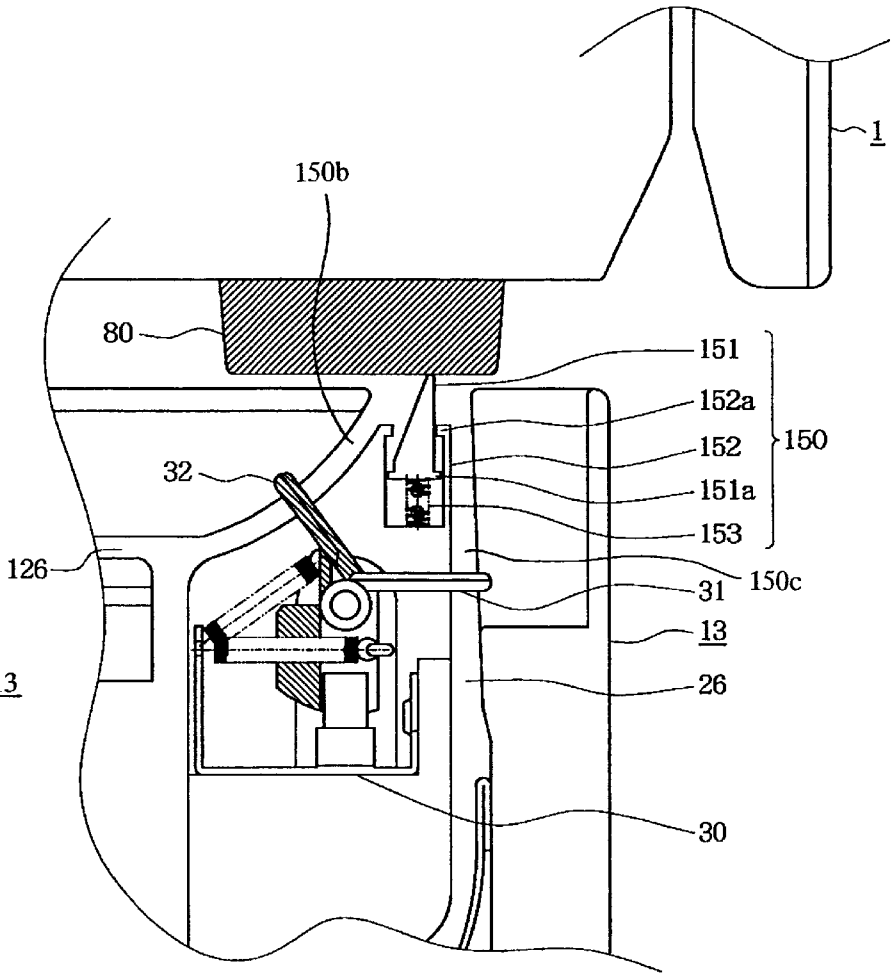
FIGS. 6(*a*) and 6(*b*) are cross sections, each showing a state of a merging guide according to a third embodiment of the invention.
Figure 6A:
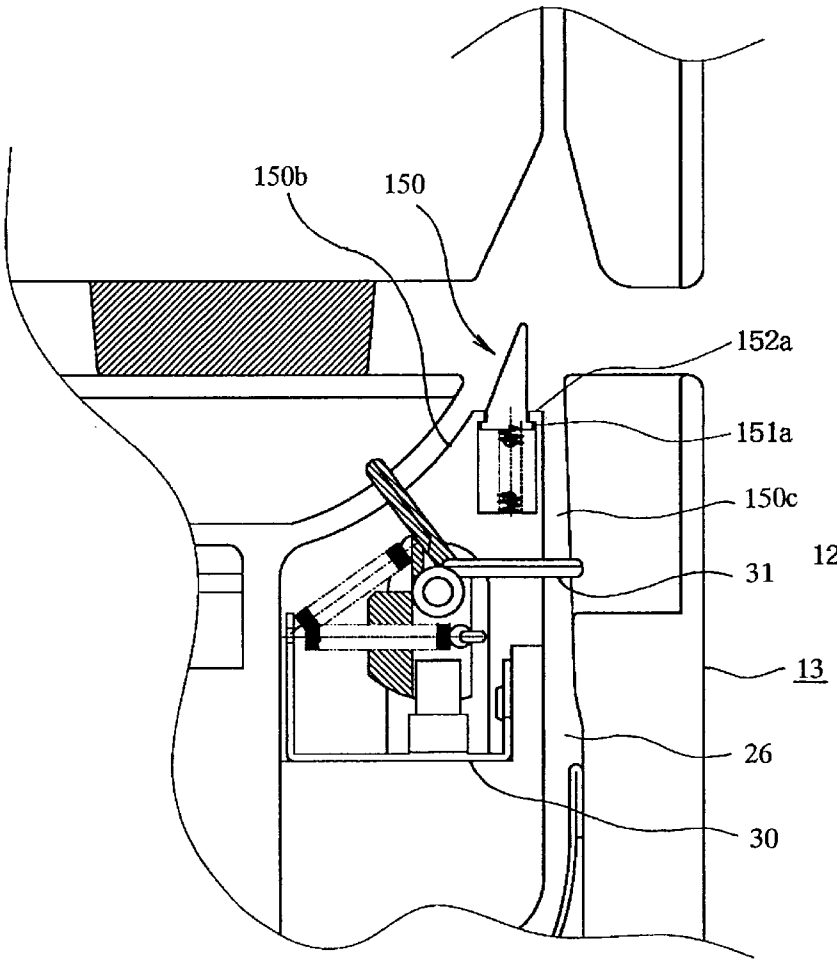

Referring to FIGS. 6(*a*) and 6(*b*), the third embodiment is described next.

In the first and second embodiments, the merging guide 50 is provided having the merging point G1 between the sheet feeding apparatus and the LBP 1, but the third embodiment has a feature that the merging guide 150 is made of two parts and that the front end member 151 moves up and down by external force. Other structures and operations are the same as those in the first embodiment, so the duplicated description is omitted.

In general, when the LBP 1 is mounted to the sheet feeding apparatus 13, several operators hold the LBP 1 and work to set the LBP 1 on the sheet feeding apparatus 13. The LBP 1 and the sheet feeding apparatus 13 are set to the right place by engaging positioning pins, not shown, formed at the sheet feeding apparatus 13 with positioning holes, not shown, formed at the LBP 1. However, in some cases, the apparatus cannot be mounted properly. In such a case, if the rubber pads 80 of the LBP 1 contact with the tip 50*a* of the merging guide, the merging guide may be disadvantageously damaged due to the weight of the LBP 1.

In this embodiment, the tip member 151 has a structure capable of escaping up to a position that the rubber pad 80 can be installed at a place capable of supporting the LBP 1.

The merging guide 150 is described herein. The tip member 151 is structure not of ribs but of a united part extending in the sheet width direction. Among parts constituting the merging guide 150, the tip member 151 is slidably provided in the up and down direction with respect to a base member 152, and the tip member 151 is urged upward at both ends by the compression spring 153. The position of the tip member is determined by contact between a stopper portion 151 a formed at the tip member 151 and a stopper portion 152*a* of the base member. In FIG. 6, the compression spring 153 located on the rear side is shown.

FIG. 6(*b*) shows a state that the rubber pad 80 is mistakenly placed on the tip portion of the merging guide 150. In this case, the tip member 151 moves down upon contraction of the compression spring 153 due to the weight of the LBP 1. This structure can prevent the merging guide 150 from being damaged.

Figure 7B:
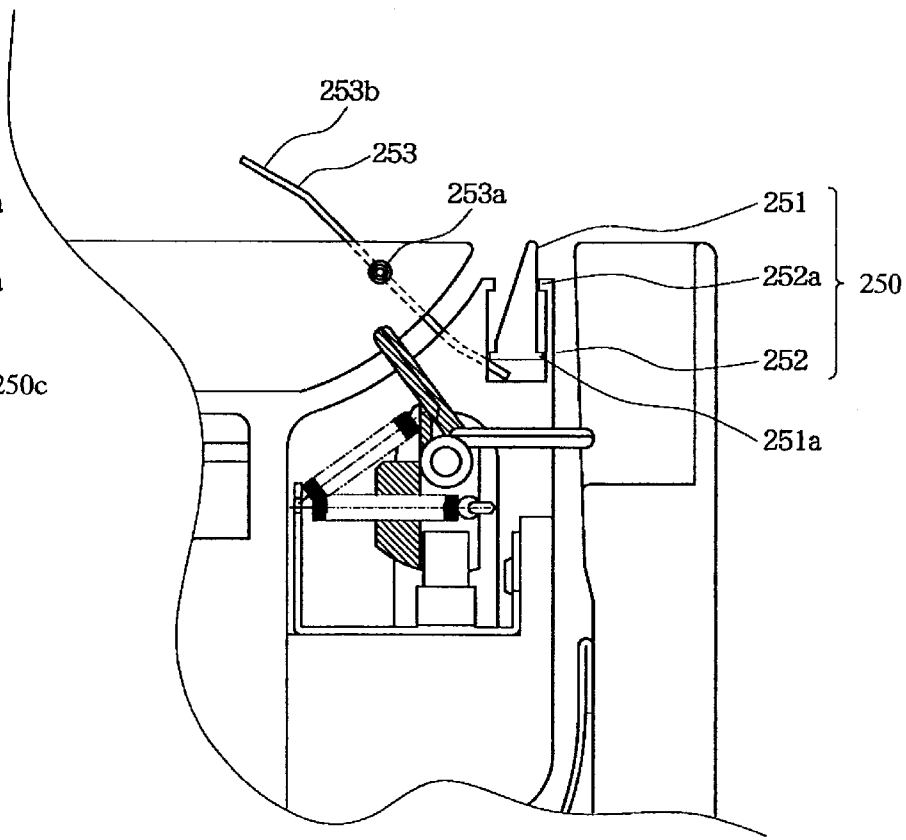
FIGS. 7(*a*) and 7(*b*) are cross sections, each showing a state of a merging guide according to a fourth embodiment of the invention.
Figure 7A:
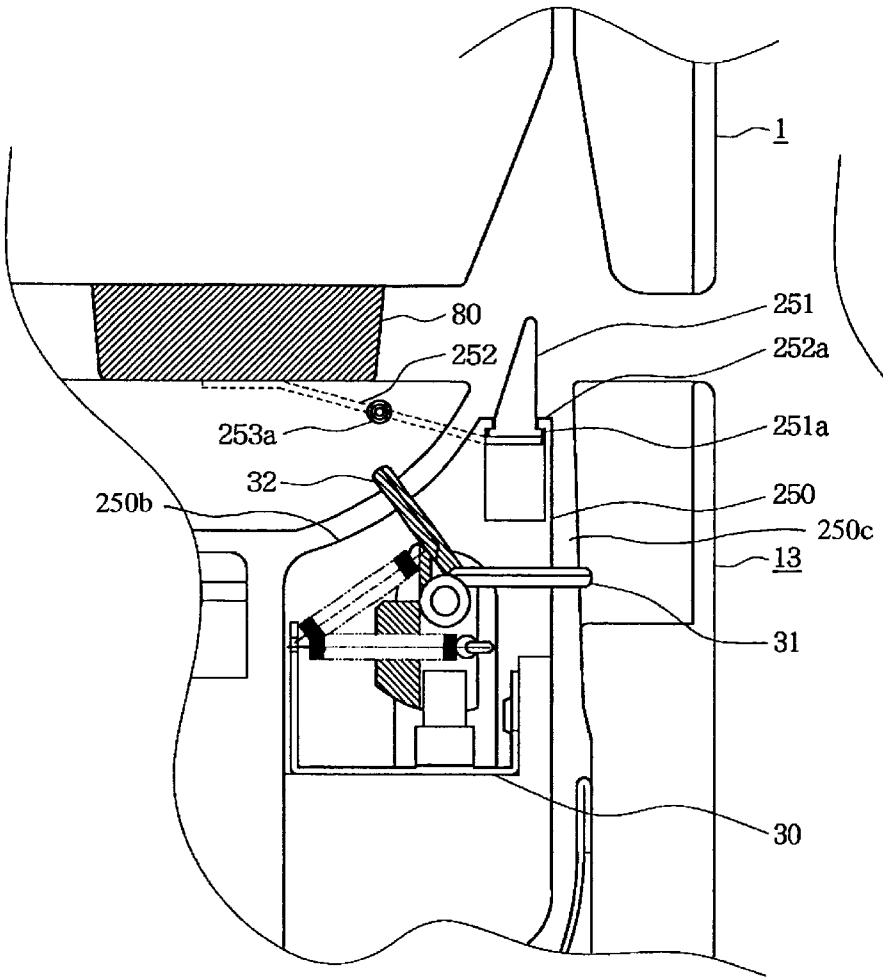
Figure 8:
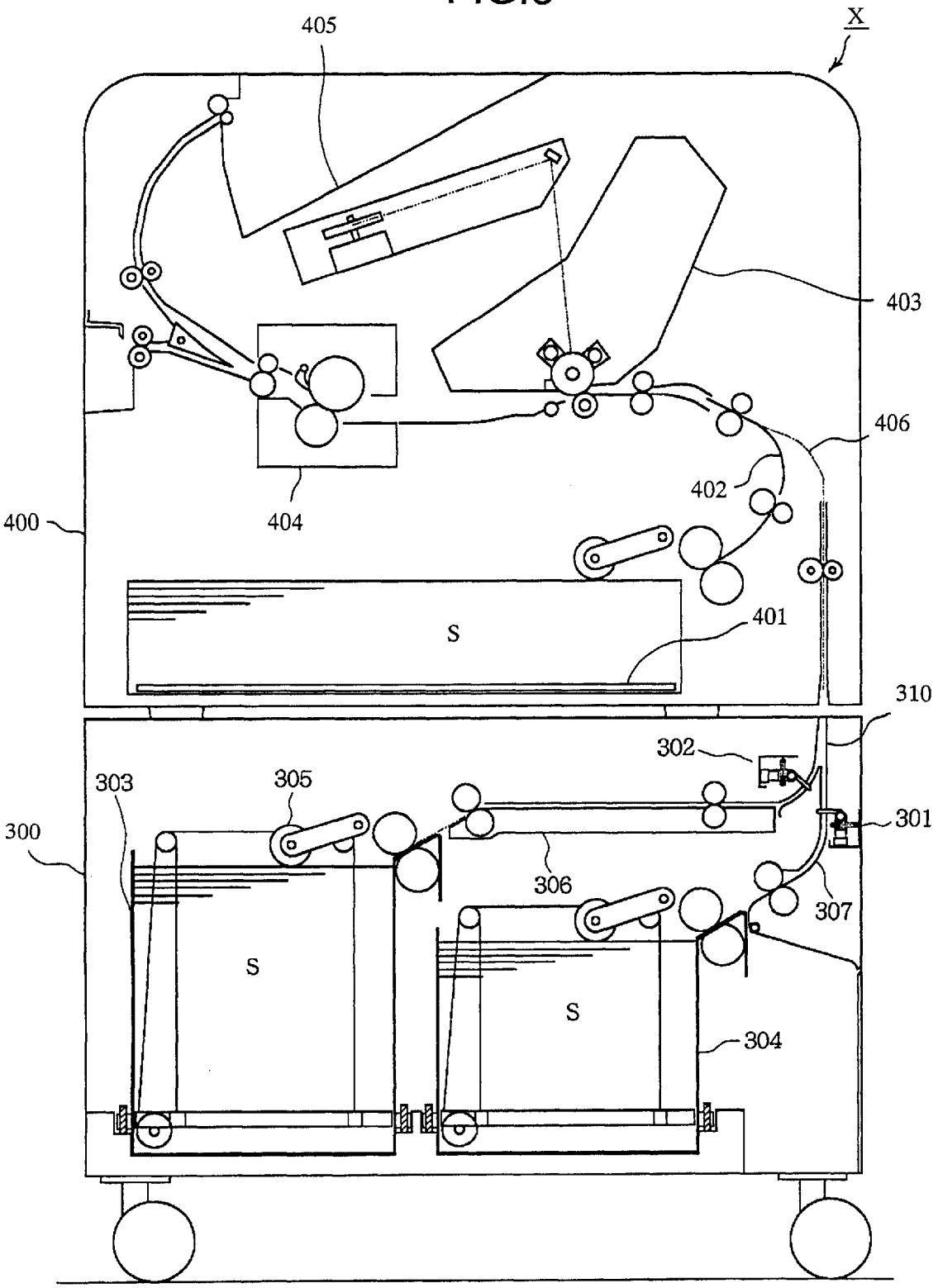
FIG. 8 is an illustration showing a conventional apparatus.

Referring to FIGS. 7(*a*) and 7(*b*), the fourth embodiment is described next.

In the third embodiment, the tip member 151 of the merging guide escapes downward when the rubber pad 80 of the LBP 1 is placed on the merging guide 150, but in the fourth embodiment, the merging guide is in an escaping state while the LBP 1 is not set on the sheet feeding apparatus 13, and the fourth embodiment has a feature that the merging guide moves upward in association with the mounting operation of the LBP 1. Other structures and operations are the same as those in the third embodiment, so the duplicated description is omitted.

Referring to FIGS. 7(*a*) and (*b*), a merging guide 250 is described herein. A tip member 251 is structure not to ribs in the same way as those in the third embodiment but of a united part extending in the sheet width direction. Among parts constituting the merging guide 250, the tip member 251 is slidably provided in the up and down direction with respect to a base member 252, and the tip member 251 is set downward where the image forming apparatus is not mounted as shown in FIG. 7(*b*).

As shown in FIG. 7(*a*), where the image forming apparatus is mounted, the rubber pads 80 urge a lever 253 upwardly at two points on a front side and a rear side at the opposite ends, thereby positioning a stopper portion 251*a* in contact with a stopper portion 252*a* of the base member. With this state, the lever 253 is projecting from the mounting surface of the rubber pads, or namely the top surface of the sheet feeding apparatus 13. A contact portion 253*b* of the lever is disposed at a position where the rubber pad is mounted.

When the image forming apparatus 1 is set at the sheet feeding apparatus 13, the rubber pad 80 rotates the lever 253 in the counterclockwise direction around a shaft 253*a*, and thereby the lever 253 pushes up the bottom of the tip member 251 of the merging guide.

According to this structure, the tip member 251 of the merging guide does not move upward until the LBP1 is mounted to a right position of the sheet feeding apparatus 13, so that the rubber pads 80 can be set without contacting with the merging guide 250 during installation.

What is claimed is:

1. A sheet conveying apparatus comprising:

a first unit including a first sheet conveyance route, a second sheet conveyance route, a first delivery opening formed at a first surface of the first unit for delivering a sheet from the first sheet conveyance route, and a second delivery opening formed at said first surface of the first unit for delivering a sheet from the second sheet conveyance route;

a second unit having a third sheet conveyance route, and a single introduction opening formed at a second surface of the second unit for introducing a sheet or sheets delivered from the first delivery opening and the second delivery opening to the third sheet conveyance route, wherein said first surface faces said second surface and there forms a space between said first surface and said second surface; and a guide member, at least a part of which is disposed at the space between the first surface of the first unit and the second surface of the second unit, having a first guide surface for guiding the sheet or sheets from the first delivery opening to the introduction opening, and a second guide surface for guiding the sheet or sheets from the second delivery opening to the introduction opening.

2. The sheet conveying apparatus according to claim 1, wherein the guide member projects from the first unit to proximity of the introduction opening.

3. The sheet conveying apparatus according to claim 1, wherein the guide member is formed to be contained in the first unit.

4. The sheet conveying apparatus according to claim 3, wherein the guide member is pulled in the first unit when pressed in contact with a part of the second unit.

5. The sheet conveying apparatus according to claim 3, wherein the guide member is contained in the first unit when the second unit is separated from the first unit and wherein the guide member projects from the first unit when the second unit is placed adjacently with a prescribed positional relation with respect to the first unit.

6. The sheet conveying apparatus according to one of claims 1 to 5, wherein the first sheet conveyance route is for conveying the sheet or sheets from a first sheet feeding means, wherein the second sheet conveyance route is for conveying the sheet or sheets from a second sheet feeding means, and wherein the third sheet conveyance route is for conveying the sheet or sheets to an image forming means for recording an image on the sheet.

7. An image forming apparatus comprising:

a first unit including a first sheet conveyance route for conveying a sheet or sheets from a first tray stacking the sheets, a second sheet conveyance route for conveying a sheet or sheets from a second tray stacking the sheets, a first delivery opening formed at a first surface of the first unit for delivering a sheet from the first sheet conveyance route, and a second delivery opening formed at a first surface of the first unit for delivering a sheet from the second sheet conveyance route;

a second unit having image forming means for forming an image on a sheet, a third sheet conveyance route for conveying a sheet or sheets to the image forming means, and a single introduction opening formed at a second surface of the second unit for introducing a sheet or sheets delivered from the first delivery opening and the second delivery opening to the third sheet conveyance route, wherein said first surface faces said second surface and there forms a space between said first surface and said second surface; and a guide member, at least a part of which is disposed at the space between the first surface of the first unit and the second surface of the second unit, having a first guide surface for guiding the sheet or sheets from the first delivery opening to the introduction opening, and a second guide surface for guiding the sheet or sheets from the second delivery opening to the introduction opening.

8. A sheet conveying apparatus comprising:

a first unit including a first sheet conveyance route, a second sheet conveyance route, a first delivery opening for delivering a sheet from the first conveyance route, and second delivery opening for delivering a sheet from the second conveyance route;

a second unit having a third sheet conveyance route, and a single introduction opening for introducing a sheet or sheets delivered from the first delivery opening and the second delivery opening to the third sheet conveyance route;

a guide member, at least a part of which is disposed at the space between said first unit and said second unit, having a first guide surface for guiding the sheet or sheets from the first delivery opening to the introduction opening, and a second guide surface for guiding the sheet or sheets from the second delivery opening to the introduction opening, first and second flags having first and second actuators, respectively, the first and second actuators being placed at a position intersecting the first and second conveyance routes, respectively;

a common rotary shaft for supporting the first and second flags so that the first actuator and the second actuator move rotationally; and a sensor for detecting rotational movement of the first actuator and second actuator.

9. The sheet conveying apparatus according to claim 8, wherein the sensor is constituted of a light emitting device and a light receiving device for producing a signal upon receiving light from the light emitting device, and wherein the flag has a light shielding portion for shielding light from the light emitting device where the first actuator and the second actuator move rotationally.

10. The sheet conveying apparatus according to claim 8, wherein the sensor is made of first and second sensors for detecting rotational movement of the first actuator and the second actuator, respectively.

11. The sheet conveying apparatus according to claim 8, wherein at least one of the first actuator and the second actuator is formed with a cutout such that the first actuator and the second actuator do not interfere with one another.

12. An image forming apparatus comprising:

a sheet feeding apparatus as set forth in one of claims 8 to 11; and image forming means for forming an image on a sheet fed by the sheet feeding apparatus.

* * * * *

UNITED STATES PATENT AND TRADEMARK OFFICE

CERTIFICATE OF CORRECTION

PATENT NO. : 6,527,267 B1
DATED : March 4, 2003
INVENTOR(S) : Takashi Kuwata et al.

It is certified that error appears in the above-identified patent and that said Letters Patent is hereby corrected as shown below:

Column 7,
Line 62, “to” should read -- of --.

Column 10,
Line 7, “opening,” should read -- opening; --.
Line 36, “feeding” should read -- conveying --; and “one” should read -- any one --.

Signed and Sealed this

Eleventh Day of November, 2003

JAMES E. ROGAN
*Director of the United States Patent and Trademark Office*